United States Patent [19]

Horstmeyer et al.

[11] Patent Number: 4,463,814

[45] Date of Patent: Aug. 7, 1984

[54] DOWN-HOLE DRILLING APPARATUS

[75] Inventors: Robert J. Horstmeyer, Palo Alto, Calif.; Larry J. Weick, West Garland, Tex.

[73] Assignee: Advanced Drilling Corporation, Mountain View, Calif.

[21] Appl. No.: 444,608

[22] Filed: Nov. 26, 1982

[51] Int. Cl.[3] ..... E21B 47/02

[52] U.S. Cl. ..... 175/45; 175/61; 175/94; 166/212

[58] Field of Search ..... 175/45, 61, 73, 75, 175/76, 77, 79, 94, 99, 103, 230; 166/212; 299/31; 174/47

[56] References Cited

U.S. PATENT DOCUMENTS

| | | | |
|---|---|---|---|
| 2,167,194 | 7/1939 | Anderson | 175/61 |
| 3,185,225 | 5/1965 | Gines | 175/94 |
| 3,224,513 | 12/1965 | Weeden, Jr. | 175/45 |
| 3,599,712 | 8/1971 | Magill | 166/212 |
| 3,992,565 | 11/1976 | Gatfield | 174/47 X |
| 4,095,655 | 6/1978 | Still | 175/94 X |
| 4,385,021 | 5/1983 | Neeley | 174/47 X |

*Primary Examiner*—Ernest R. Purser
*Assistant Examiner*—Thuy M. Bui
*Attorney, Agent, or Firm*—Thomas E. Schatzel

[57] ABSTRACT

A down-hole drilling apparatus having a drill tool assembly with a cutting head at one end connected to an umbilical which extends to a retrieval reel on the surface. The umbilical provides electrical power, drilling fluid and means for instrumentation and control signals to be transmitted between the drill tool assembly and a processing device on the surface. The drill tool assembly can propel itself into or out of a bore hole by the cyclical actuation of anchor and ram units or change the direction of drilling by actuation of thruster assemblies in response to control signals sent manually by an operator or automatically by the processing device.

10 Claims, 14 Drawing Figures

DOWN-HOLE DRILLING APPARATUS

BACKGROUND OF THE INVENTION

1. Field of the Invention

The invention relates generally to earth drills and more particularly to a drilling system wherein a self-propelled down-hole drilling tool is connected to the surface through a flexible umbilical.

2. Description of the Prior Art

Typically, drilling means use a drill string of pipe segments through which the torque necessary to operate a drill bit is transmitted. As the depth of the hole increases, power loss increases significantly mainly due to friction between the drill string and the bore wall. Another characteristic of conventional drills is the length of time it takes to remove the bit from the hole and return it. This is known as "trip time". When drill strings are used, trip time represents a significant non-productive time.

Besides transmitting the torque necessary to rotate a drill bit, the weight of the drill string provides the axial force at the drill bit needed to force the drill bit into the formation to be drilled.

An early example of a device eliminating the drill string is shown in U.S. Pat. No. 1,118,001 issued to May where a pneumatically operated drill and anchoring system is disclosed. Another anchoring system using an expandable bladder to both seal the hole and provide an anchor is shown in U.S. Pat. No. 3,376,942 issued to VanWinkle.

In order for a drill system to be independent of a drill string, it must be able to propel itself within the drill hole. Most systems using this method use a combination of a thrusting device to put force on the drill bit and dual anchoring systems to permit the drill tool to advance within the hole as the hole is deepened by action of the drill bit. Examples of such systems are shown in U.S. Pat. No. 3,354,969 issued to Ebeling, U.S. Pat. No. 3,797,589 issued to Kellner, and U.S. Pat. No. 4,060,141 issued to Catterfeld. Other combinations of anchoring devices and thrusting devices are disclosed in U.S. Pat. No. Re. 28,449 issued to Edmond and U.S. Pat. No. 3,978,930 issued to Schroeder.

SUMMARY OF THE INVENTION

It is therefore an object of the present invention to provide a self-contained hydraulically powered down-hole drill tool.

It is a further object to provide a drill tool which reduces trip time.

It is a further object to provide a down-hole drill tool which can transmit real time drill and formation parameters without interruption of the drilling operation.

It is a further object to provide a self-propelled drill which can anchor and advance itself without interruption of axial force on the drill bit.

It is a further object to provide a self-propelled drill tool which can change its direction of drilling in any direction.

It is a further object to provide a hydraulically powered down-hole drill tool where the drilling fluid does not enter the internal structure of the tool thereby eliminating corrosion or errosion from the drilling fluid and permitting optimization of drilling fluid parameters without regard to any power requirement of the drill tool.

It is a further object to provide a hydraulically powered down-hole drilling tool with a flexible umbilical which can supply electric or hydraulic power to the tool.

It is a further object to provide a hydraulically powered down-hole drilling tool where all hydraulic power is generated down-hole to reduce pressure losses associated with a length of umbilical transmitting hydraulic pressure to the tool.

It is a further object to provide a down-hole drill tool where internal hydraulic pressure is greater than external drilling fluid pressure to prevent entry of drilling fluid into the internals of the tool.

It is a further object to provide a down-hole drill tool with an anchor system which fails in a position permitting retrieval of the tool.

It is a further object to provide a down-hole drill tool which can propel itself out of the drill hole in the event that its surface retrieval system becomes inoperative.

Briefly, the present invention includes a system for drilling holes in the earth of a size typically encountered in oil and gas well drilling. The invention permits drilling in both vertical and horizontal directions and does not rely on gravitational forces to produce forward thrust on the bit.

The invention includes a continuous flexible umbilical that provides power, drilling fluid, control and instrumentation signals between the surface and a down-hole drilling tool. The down-hole tool includes functions for sensing the tool location and orientation, tool operating parameters, such as drill bit RPM and formation conditions such as temperature and pressure. The tool includes hydraulic motors to rotate the drill bit, anchor means to transmit the reactive forces of bit thrust and torque to the well walls, thruster means to force the drill bit forward or to retrieve the tool and side thruster means to force the tool to drill in a desired direction. The invention also includes a surface processor to monitor tool direction and performance and to adjust the tools operating functions to obtain the desired tool direction and to optimize the performance of the drill bit.

An advantage of the down-hole drill tool system of the present invention is that it is a self-contained hydraulically powered unit.

Another advantage is that the down-hole drill tool system reduces trip time.

It is a further advantage that the down-hole drill tool transmits real time drill and formation parameters without interruption of the drilling operation.

A further advantage is that the present invention can anchor and advance itself without reduction of axial force on the drill bit.

Another advantage is that the present invention can change its direction of drilling to any direction.

It is a further advantage that the present invention eliminates corrosion and errosion due to the internal presence of drilling fluid and permits optimization of drilling fluid parameters without regard to any drilling requirement to the drill tool.

A further advantage is that the present invention has a flexible umbilical which can supply electric or hydraulic power to the drill tool.

A further advantage is that the present invention can generate all hydraulic power down-hole which reduces the power losses associated with the length of umbilical transmitting the hydraulic pressure to the tool.

A further advantage is that the present invention prevents contamination of the internals of the tool with drilling fluid by maintaining internal hydraulic pressure greater than the pressure of the external drilling fluid.

A further advantage is that the anchor system of the present invention fails in a position permitting retrieval of the tool.

A further advantage is that the down-hole drill tool of the present invention can propel itself out of the drill hole in the event that its surface retrieval system becomes inoperative.

These and other objects and advantages of the present invention will no doubt become obvious to those of ordinary skill in the art after having read the following detailed description of the preferred embodiments which are illustrated in the various drawing figures.

IN THE DRAWING

DETAILED DESCRIPTION OF THE PREFERRED EMBODIMENTS

Figure 1:
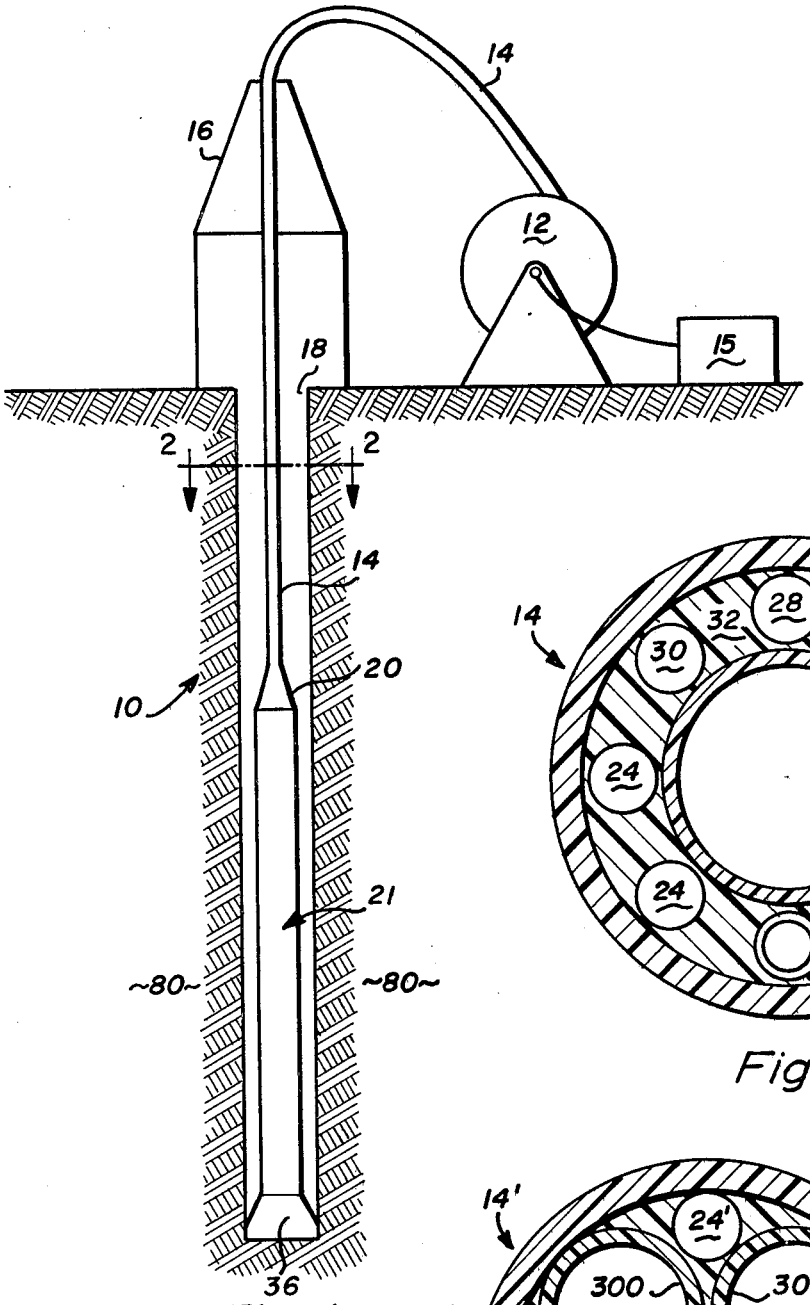
FIG. 1 is an elevational view of a down hole drilling apparatus in accordance with the present invention.

In FIG. 1, there is illustrated a down-hole drilling apparatus referred to by the general reference numeral 10 incorporating the present invention. The drilling apparatus includes a reel 12 about which an umbilical 14 is wound. An electronic processor 15 electrically connected to umbilical 14. The umbilical 14 is deployed through a rig 16 into a bore 18. A terminal end 20 of umbilical 14 is connected to a drilling tool assembly referred to by the general reference numberal 21. The umbilical 14 and drilling tool assembly 21 are deployed and retreived using any of several existing systems for handling reels of continuous lengths of hose such as a coiled tubing work-over rig.

Figure 2:
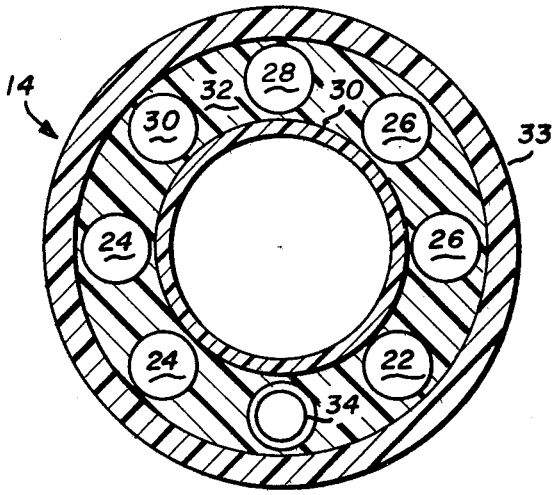
FIG. 2 is a cross-sectional view of the umbilical taken along the line 2—2 of FIG. 1.

As illustrated in FIG. 2, umbilical 14 includes lifting cables 22, control wires 24, instrumentation wires 26 and a power cable 28 which are wrapped in a spiral or straight fashion about a drilling fluid supply hose 30. Void spaces are filled with plastic 32 and the hose, wires and cables are placed in a heat shrinkable abrasion proof tubing 33. Alternatively, the hose, wires and cables may be wrapped in any abrasion proof covering. Also, the umbilical 14 may include a hydraulic reservoir make up hose 34 which is also depicted in FIG. 2. The result is an umbilical 14 which is flexible but semi rigid having a generally circular cross-section that is compatible with standard blow out prevention equipment. An alternative umbilical of a more rugged construction is commercially available from Coflexit Corporation.

Figure 3:
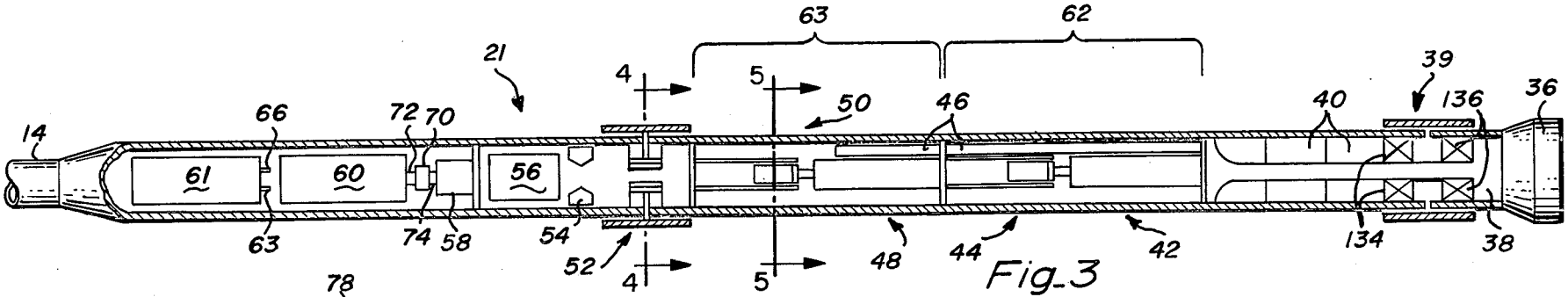
FIG. 3 is a cross-sectional view of the drill tool assembly.

Referring to FIG. 3, the drilling tool assembly 21 includes a cutter head 36, a cutter head sub 38, a first thruster assembly 39, hydraulic motors 40, a first hydraulic ram assembly 42, a first anchor assembly 44, a down-hole sensing device 46, a second hydraulic ram assembly 48, a second anchor assembly 50, a second thruster assembly 52, a coupling U-joint 54, a hydraulic system control device 56, a hydraulic pump 58, an electric motor 60 and a hydraulic reservoir 61, all as arranged in FIG. 3. The first hydraulic ram assembly 42 and first anchor assembly 44 in combination comprise a first anchor and ram unit 62. Likewise, ram assembly 48 and anchor assembly 50 comprise a second anchor and ram unit 63.

Cutter head 36 can be a number of conventional cutting devices including a drill bit, drag bit, coring bit, auger, milling bit and underreamer.

A hydraulic distribution system comprising of standard hydraulic piping and valves extends the length of the housing assembly 21 supplying the various hydraulic components. The hydraulic reservoir 61 contains hydraulic fluid and is connected to the hydraulic pump 58 by a suction line 66 and to a hydraulic system return line 68. The hydraulic pump 58 is a conventional hydraulic pump connected to the electric motor 60 through a standard mechanical coupling 70 such that the rotation of electric motor shaft 72 causes the hydraulic pump shaft 74 to rotate driving the pump 58. The output of pump 58 is connected to the supply line 75 of hydraulic distribution system. The hydraulic distribution system is described in greater detail below.

Figure 4:
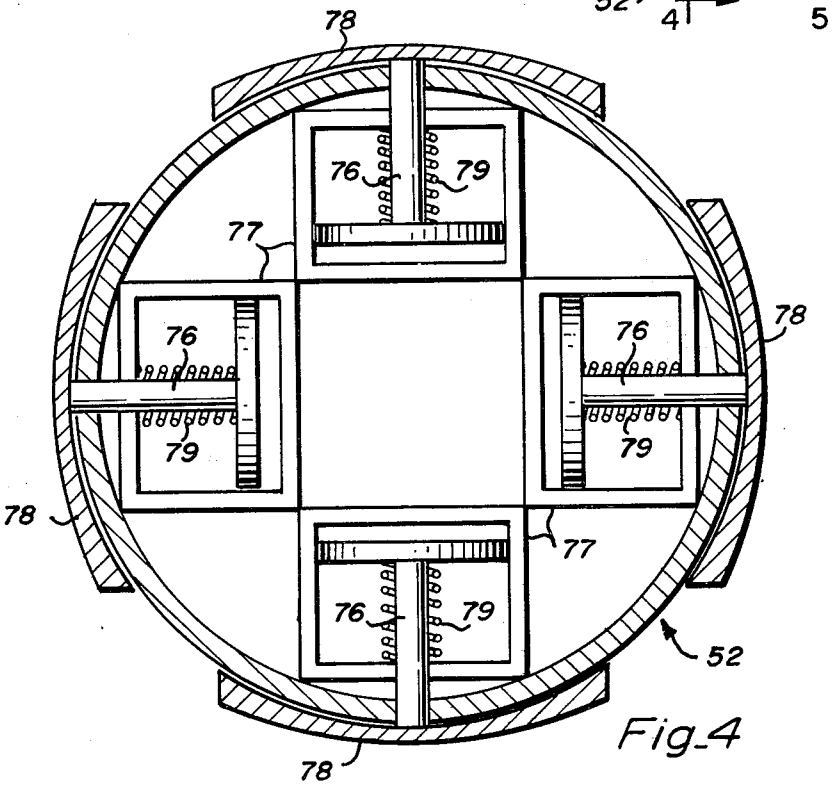
FIG. 4 is a cross-sectional view of the thruster assembly taken along the line 4—4 of FIG. 3.

The thruster assemblies 39 and 52 are of similar construction and only thruster assembly 52 will be described. As illustrated in FIG. 4, thruster assembly 52 includes a plurality of dual acting hydraulic actuators 76 capable of individual operation and contained within actuator housings 77. Attached to the ends of actuators 76 are thruster feet 78. Each actuator housing 77 also contains a spring 79 located about the actuator 76.

Figure 5:
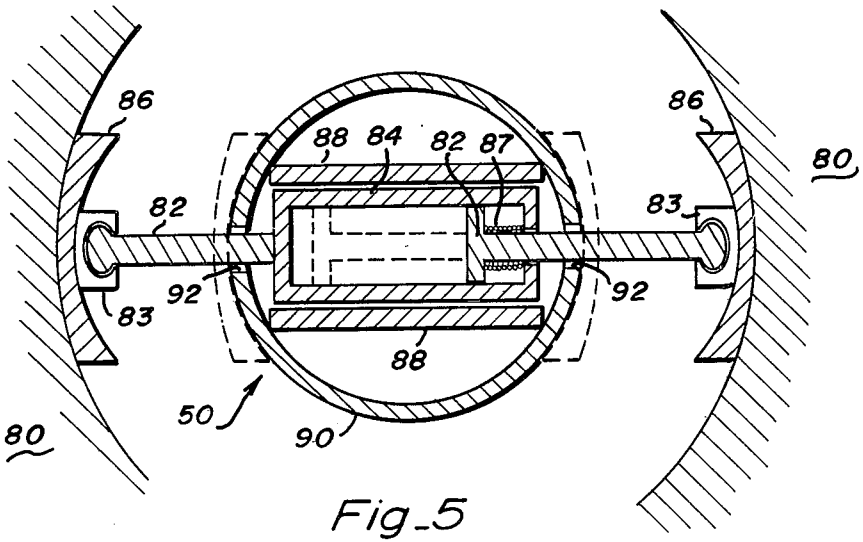
FIG. 5 is a cross-sectional view of the anchor assembly taken along the line 5—5 of FIG. 3.
Figure 6:
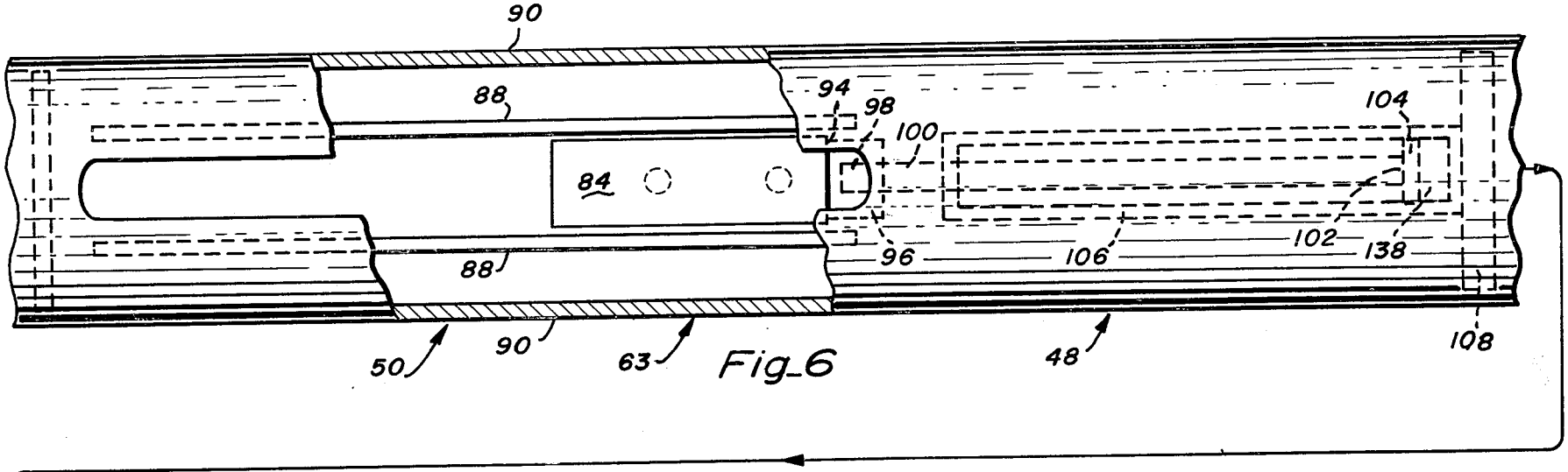
FIG. 6 is a partial cross sectional view of the anchor and ram units.

As illustrated in FIG. 5, anchor assembly 50 (anchor assembly 44 is of similar construction) includes a plurality of dual acting hydraulic actuators 82 contained within an actuator housing 84. Connected to actuators 82 by ball and socket 83 are anchor feet 86 shown engaged with bore wall 80. The anchor feet 86 act to distribute the bearing force against the bore wall 80 and to incur any abrasion from wearing against the formation. The cross sectional area of the actuators 82 may take any of several forms including circular, oval or elongated. The actuators 82 being dual acting provide positive force and control in removing the feet 86 into and away from bore wall 80. Each actuator 82 has a spring 87 about it (shown compressed with anchor foot 86 engaged with bore wall 80 in FIG. 5). As illustrated in FIG. 6, anchor guides 88 are rigidly attached to housing assembly wall 90. Longitudinal anchor slots 92 are provided in the housing wall 90 to allow housing assembly 21 to move relative to anchor assembly 50 during operation of the drilling apparatus 10. Anchor assembly 50 is connected to hydraulic ram assembly 48 as described below forming anchor and ram unit 63. Lower surface 94 of actuator housing 84 is rigidly attached to a ram socket 96 adapted to receive a first end 98 of a piston shaft 100. A second end 102 of piston shaft 100 is attached to a piston 104 which is contained within a cylinder 106. Cylinder 106 is rigidly fixed to cross-member 108 which in turn is rigidly fixed to housing assembly wall 90. Thus, the anchor and ram unit 63 is connected to the body of the drill tool assembly 21 in such a manner that the reactive thrust and torque of cutter head 36 are transmitted to the bore wall 80 while allowing for small angular displacement of the drill tool 21 body and angular misalignment between the individual anchor and ram units 62 and 63 in two degrees of freedom.

Figure 7:
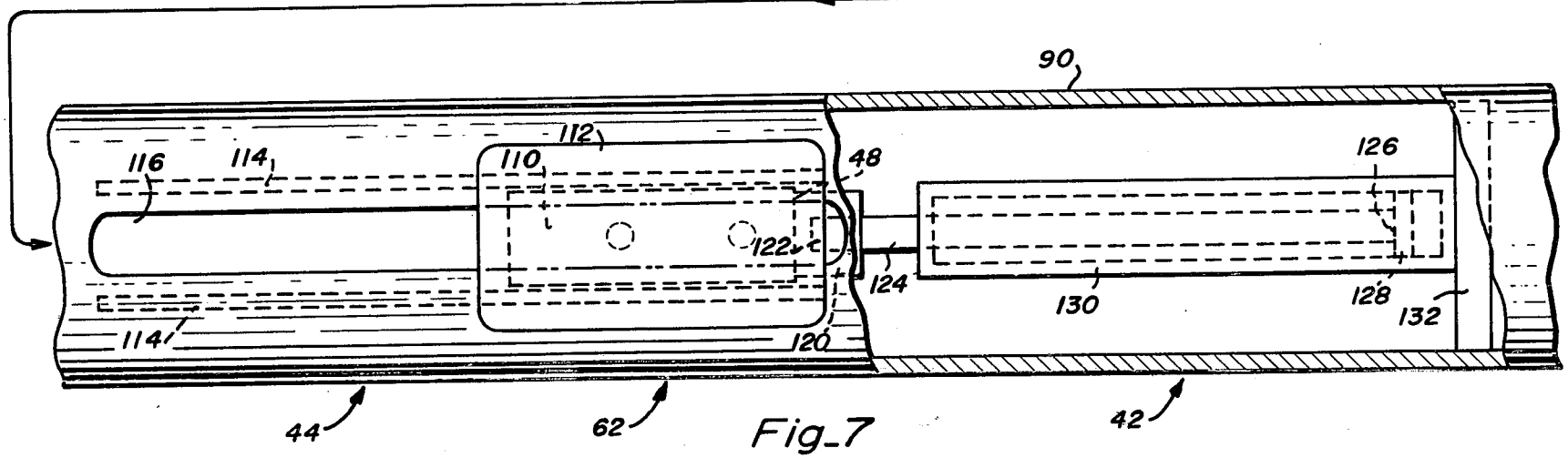
FIG. 7 is a continuation of FIG. 6.

As illustrated in FIG. 7, anchor assembly 44 and ram assembly 42 which are constructed and connected in the same manner as described above for anchor assembly 50 and ram assembly 48 include an actuator housing 110, anchor feet 112 (only one shown), anchor guides 114, longitudinal anchor slots 116, a lower surface 118 of actuator housing 110, a ram socket 120, a first end 122 of a piston shaft 124, a second end 126, a piston 128, a cylinder 130 and a cross-member 132.

Below ram assembly 42 are mounted the hydraulic motors 40 which are coupled mechanically in a conventional manner to the drill bit 36, such coupling passing through thuster assembly 39, cutter head bit sub 38 and upper and lower bearing assemblies 134 and 136.

Figure 8:
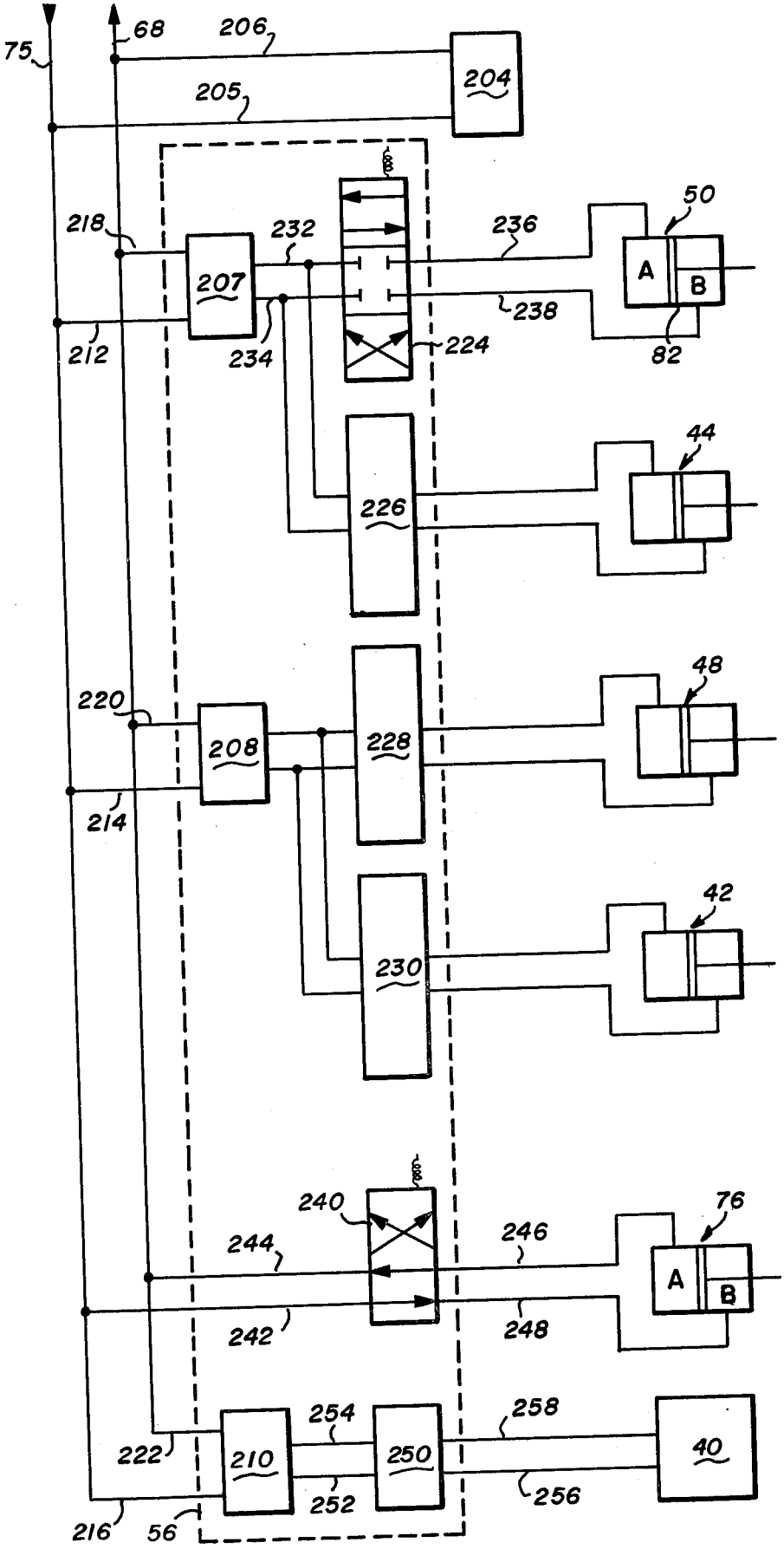
FIG. 8 is a schematic of the hydraulic distribution system.

A schematic diagram of the hydraulic distribution system is shown in FIG. 8. The system includes supply line 75 which is connected to the discharge of hydraulic pump 58 and return line 68 which is connected to the hydraulic reservoir 61. Each hydraulic component is connected to both the supply and return lines 75 and 68. A pressure relief valve 204 senses pressure in supply line 75 through a line 205 and dumps hydraulic fluid from the supply line 75 into the return line 68 through a line 206 to reduce supply line 75 pressure when a preset pressure is reached.

There are three similarly constructed pressure control solenoid valves 207, 208 and 210 for the anchors, the rams and hydraulic motors, respectively. The desired pressure for a particular component can be maintained by a control signal to the respective solenoids transmitted over the control wires from the surface. The pressure control solenoid valves 207, 208 and 210 are connected to the supply line 75 by lines 212, 214 and 216 and to return 68 by lines 218, 220 and 222, respectively.

The position control solenoid valves 224, 226, 228 and 230 for the anchors and rams respectively are of similar construction and operation and only valve 224 will be described. The valve 224 is connected to pressure control solenoid valve 206 by lines 232 and 234. Position control valve 224 is operated by solenoids which position the valve internals such that three separate hydraulic fluid paths can be created. In the neutral position, flow to and from ram assembly 50 is blocked. In the second position hydraulic fluid from supply line 75 is applied to side A of actuator 82 through a line 236 and hydraulic fluid from side B of actuator 82 is lined up to return line 68 through a line 238. In the third position, supply line 75 is hydraulically connected to side B through line 238 and the return 68 to side A through line 236. The position of anchor position control solenoid valve 224 is controlled by control signals from the surface sent over control wires 24 which energize the solenoids associated with the valve to achieve the desired valve position.

Each individual actuator 76 of thruster assemblies 39 and 52 has its own position control valve so that the desired actuator can be individually operated. Since all such valves are of similar construction and operation only one such valve, thruster position control solenoid valve 240, is shown on FIG. 8. Valve 240 is connected to supply and return lines 75 and 68 by lines 242 and 244 respectively. Valve 240 is a two position valve. In one position supply line 75 is connected to side A of actuator 76 through a line 246 and return line 68 is connected to side B of actuator 76 through a line 248. In the other position supply line 75 is connected to side B of actuator 76 through line 248 and return line 68 is connected to side A of actuator 76 through line 246. Like the other solenoid valves described above, thruster position control solenoid valve 240 is controlled by control signals sent from the surface over control wires 24.

Hydraulic fluid is supplied to hydraulic motors 40 through pressure control valve 210 as described above. Supply line 75 through valve 210 is connected to a flow control valve 250 by line 252. Valve 250 is connected to the return line 68 through a line 254. Hydraulic motor 40 is connected to the supply and return lines 75 and 68 by lines 256 and 258 respectively. The flow of hydraulic fluid to hydraulic motor 40 is controlled by signals transmitted from the surface over control wires 24 to position flow control valve 250 to provide the desired flow rate. As shown on FIG. 8, most of the valves described above are contained in hydraulic system control device 56.

Each component serviced by the hydraulic distribution system has sensors which monitor various parameters associated with a particular component. For anchor, ram and thruster assemblies 42, 48, 44, 50, 39, and 52 respectively, the mechanical position of and hydraulic pressure on their respective piston and actuators is sensed. For motor 40, the rpm of the cutter head 36 is measured. Each of these sensors is electrically connected by instrumentation wires 26 running from the drill tool assembly 21 through umbilical 14 to electronic processor 15.

Prior to use of the down-hole drilling apparatus 10, a hole must be prepared such that the drilling tool assembly 21 may be deployed into the hole with the cutter head 36 resting on the bottom of the hole and at least the first anchor assembly 44 below the surface of the hole. With the drilling tool assembly 21 in such a position normal operation can begin.

Power is supplied to the electric motor 60 and the hydraulic system control device 56 through power cable 28 in umbilical 14. Motor 60 drives hydraulic pump shaft 74 through motor shaft 72 and coupling 70 causing hydraulic pump 58 to supply hydraulic fluid under pressure to the various hydraulic components as directed by the hydraulic system control device 56. With the anchor feet assemblies 44 and 50 in their retracted position as shown in phantom on FIG. 5 and with ram assemblies 42 and 48 in the reset positions as shown on FIGS. 6 and 7, the hydraulic system control device 56 directs hydraulic fluid to anchor assembly 50 (operation can begin by using either anchor assembly, initially).

Figure 9:
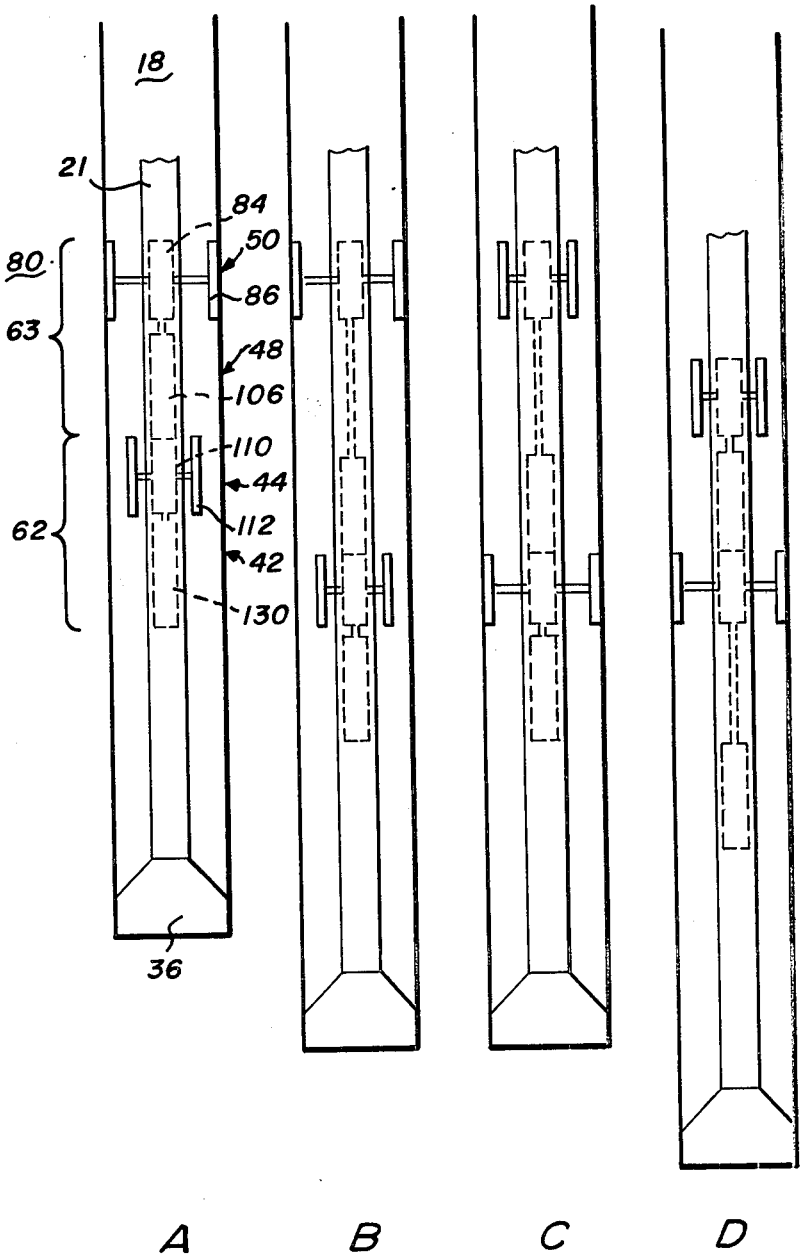
FIG. 9 is a view of the drill tool assembly showing the cutter head advancing by use of the anchor and ram units.

As shown on FIG. 5, hydraulic pressure is exerted on actuators 82 overcoming the force of spring 87 causing anchor feet 86 to be forced into engagement with bore wall 80. In FIG. 9A the drilling tool assembly 21 is shown with anchor assembly 50 engaged with bore wall 80. FIGS. 9B, C, and D show the progress of the drill tool assembly 21 as will be described below. Referring to FIGS. 6 and 7, hydraulic pressure is then applied to ram assembly 48 causing hydraulic fluid to act on the bottom of piston 104 and cylinder space 138 below the piston 104. Since piston 104 is connected to the engaged anchor assembly 50 through shaft 100 and socket 96, axial force is exerted on the drilling tool assembly 21 through cross member 108 in the direction of cutter head 36. Thus, the cutter head 36 is forced deeper into the formation in which it is drilling. Drilling fluid pumped through umbilical 14 and passing the drill tool assembly 21 and cutter head 36 removes the cuttings in a manner similar to cuttings removal in conventional rotary drilling. As piston 104 moves with respect to cylinder 106, the drilling tool assembly 21 moves with respect to actuator housing 84 such that the actuator 84 remains stationary with respect to bore wall 80 while anchor guides slide by actuator housing 84. Longitudinal anchor slot 92 permits the movement of the drilling tool assembly without interference with hydraulic actuators 82 and anchor feet 86. This relative movement continues until piston 104 reaches the limit of its stroke.

As such limit is reached, hydraulic pressure is applied to anchor assembly 44 causing its anchor feet to engage bore wall 80 as described above for anchor assembly 50. When anchor assembly 44 has been engaged with bore wall 50, anchor assembly 50 is disengaged from bore wall 80 by applying hydraulic pressure to the spring side of actuator 82 such that anchor feet 86 are retracted inward. At the same time as anchor assembly 50 is disengaged, hydraulic pressure is applied to ram assembly 42 such that axial force is transmitted to cutter head 36 in the same manner as described above for ram assembly 48. While ram assembly 42 is in operation, hydraulic pressure is applied to the opposite side of piston 104 in ram assembly 48 causing actuator housing 84 to slide in anchor guides 88 and returning anchor housing 84 to its original reset position. This alternate operation and resetting of the anchor and ram units 62 and 63 continues until the drilling tool assembly 21 reaches the desired location or depth within the formation.

It can be seen from the position of springs 87 with respect to hydraulic actuators 82 that upon a loss of hydraulic pressure due to a hydraulic distribution system failure, spring 87 will expand to cause anchor feet 86 to disengage from bore wall 80. This fail-safe design allows the drill tool assembly 21 to be removed from the bore 18 for repair in the event of a hydraulic failure. Alternatively, the springs can be mounted external to the housing assembly wall 90 such that the springs would tend to resist movement of anchor feet 86 from the retracted position and again provide for retraction of anchor feet 86 in the event of a hydraulic failure.

Each anchor and ram unit 62 and 63 operates independently of the other and can be controlled either manually or automatically to provide a continuous motion forward or backward. The ram assembly pressures are variable so that any combination of anchors may simultaneously be engaged. The ram assembly's total force against the cutter head 36 is thus controlled to a desired amount. The anchor and ram units 62 and 63 are of unitized construction, such that more than two such units may be included in the drill tool assembly 21. Addition of such units can be used to increase the total holding force and consequent thrust on cutter head 36. Also, additional units provide redundancy in the event of anchor and ram unit failure. The exact number of units can be determined for each drilling application from the expected life of the cutter head 36 and the mean failure time for each anchor and ram unit.

The direction of drilling can be altered by the operation of thruster assemblies 39 and 52. During directional changes using thruster assemblies 39 and 52, the anchor assemblies 44 and 50 are disengaged thus exerting no axial force on the drill bit. For purposes of this description it is assumed that the longitudinal axis of the drill tool assembly 21 is originally perpendicular to the surface. Hydraulic pressure is applied to one of the hydraulic actuators 76 of thruster assembly 52 illustrated in FIG. 4 such that the force of spring 79 is overcome and the thruster foot 78 associated with the hydraulic actuator 76 selected is forced radially outward into an engagement with the bore wall 80. In a similar manner one of the thruster feet associated with thruster assembly 39 is also engaged with bore wall 80. Selection as to which thruster feet of thruster assemblies 39 and 52 are to be operated is based on the direction in which it is desired to drill. The thruster assemblies 39 and 52 provide a sideward force which causes the cutter head 36 to drill sideways when it is rotated.

Figure 10:
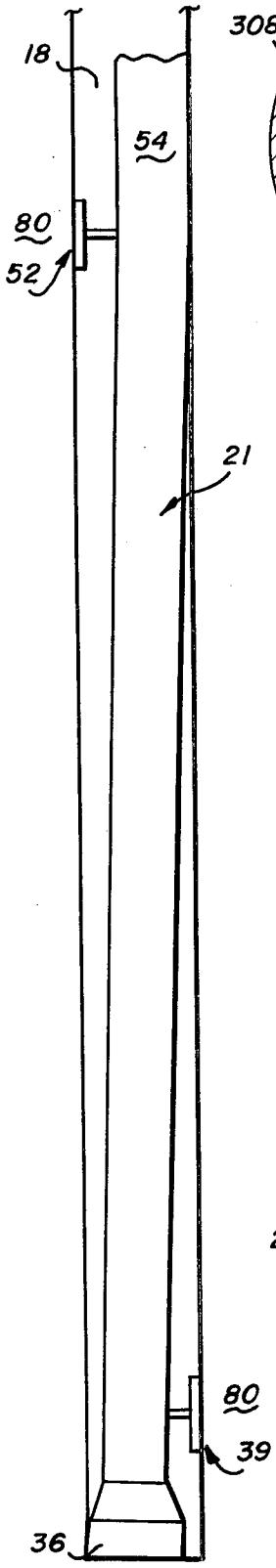
FIG. 10 is a view of the drill tool assembly changing direction.

The position of the drill tool assembly 21 within bore 18 during thruster operation is shown in FIG. 10. With the drill tool assembly 21 canted a small amount in the bore 18, normal drilling is resumed until the drill tool assembly 21 is again in position to be realigned. The operation of thruster assemblies 39 and 52 is then repeated until the drill tool assembly 21 is oriented in the desired direction. It should be noted that by utilizing a conventional cutting bit for cutter 36, the drill tool assembly 21 can be used to mill through well casing when thruster assemblies 39 and 50 are operated as described above. As discussed above for the anchor springs 87, the thruster springs 79 similarly will cause thruster feet 78 to be retracted upon a failure of the hydraulic system. Also, the thruster spring 78 may be mounted externally in the manner described for the anchor springs 87.

The operation of the drill tool assembly 21 can be either manual or automatic. Drill tool assembly 21 location and orientation is provided by sensing device 46 which can be a type made by Develco, Inc. This information is transmitted by instrumentation wires 26 to the surface through umbilical 14. In a manual mode, an operator can cause the drill tool assembly 21 to drill and reorient itself by manually activating switches sending electrical signals over control wires 24 to the hydraulic system control device 56 which activates the desired hydraulic components of the drill tool assembly 21, i.e. motor 40, thruster assemblies 39 or 52, anchor assemblies 44 or 50, and ram assemblies 42 or 48.

In an automatic mode, the electronic processor 15 receives drill tool assembly 21 location and orientation information from sensing device 46 as well as position and pressure information from sensors for each hydraulic component or the drill tool assembly 21, i.e. motor rpm, anchor, ram and thruster extension and pressures, etc. The processor 15 compares the drill tool assembly's 21 orientation and operation with preset instructions, computes which hydraulic component should be activated or modified, and sends a control signal over control wires 24 via umbilical 14 to the hydraulic system control device 56 to activate or change the state of any hydraulic component in the drill tool assembly 21. Processor 15 is thus programmed to sequence valves in control device 56 to automatically move the drill tool assembly 21 forward or backward and to activate thruster assemblies 39 and 52 as required to obtain any desired drill tool assembly 21 orientation.

Figure 11:
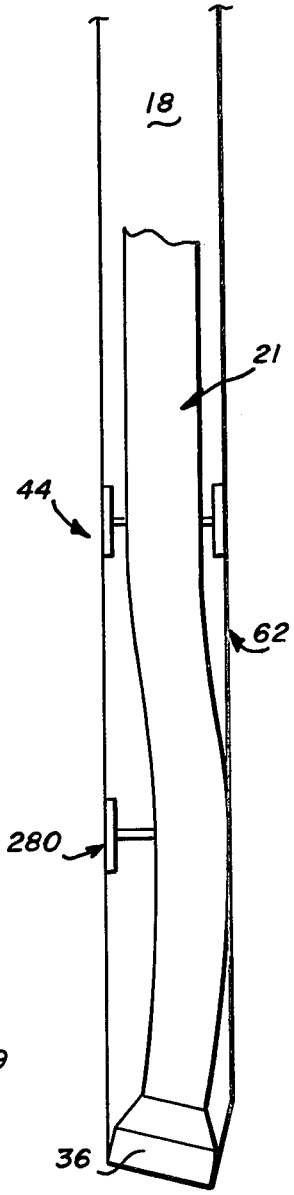
FIG. 11 is a view of an alternative embodiment of the present invention showing an alternative means for changing direction.

An alternative means for changing direction of the drill tool assembly 21 is illustrated in FIG. 11. A thruster assembly 280 is mounted on a spline sliding track (not shown) midway between drill bit 36 and anchor and ram unit 62. Thruster assembly 280 is of similar construction and operation, as thruster assemblies 39 and 52 described above. By actuating one or more of the dual acting hydraulic actuators of assembly 280 causes a side force on the drill tool assembly 21 which deforms it to a small degree, thus changing the angle of attack of the face of cutter head 36 by a small amount. This change of cutter head face angle causes it to drill in an arc. When using thruster assembly 280 to change drilling direction, the drill bit 36 is rotated and one or more anchor and ram units, 62 or 63, are in operation exerting an axial force on cutter head 36. A longitudinal slot (not shown) similar to slots 92 and 116 is provided in drilling tool assembly 21 which allows thruster assembly 280 to remain stationary with respect to bore wall 80 when engaged, and allows drill tool assembly 21 to move relative to thruster 280 as drilling progresses. The movement of thruster 280 is equal to the stroke of ram assemblies 42 and 48. At the end of travel of thruster 280, a small actuator (not shown) restores thruster 280 to its original position.

Figure 12:
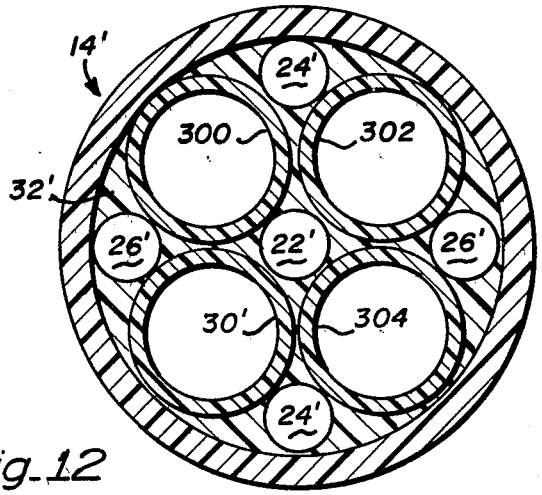
FIG. 12 is a cross sectional view of an alternative umbilical.

An alternative embodiment of the present invention includes an apparatus which has hydraulic power supplied from the surface. In such an embodiment, umbilical 14' as shown in FIG. 12 contains a hydraulic supply hose 300, a hydraulic return hose 302, a lifting cable 22', control wires 24', instrumentation wires 26' and a drilling fluid supply hose 30'. In another embodiment, a cuttings return hose 304 may be included in umbilical 14'.

Figure 13:
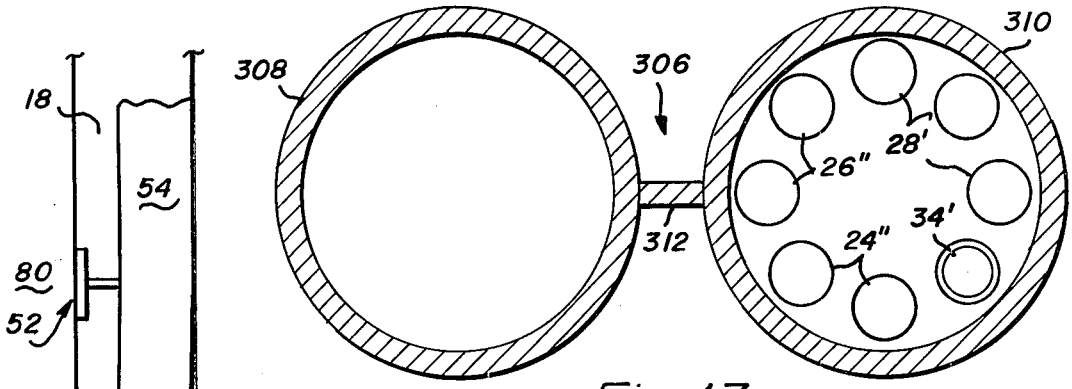
Fig. 13 is a cross-sectional view of a second alternative umbilical.

Another alternative embodiment of the present invention includes an umbilical which is compatible with existing coiled tubing equipment. As illustrated in FIG. 13, a dual string coiled tubing umbilical 306 includes a drilling fluid tube 308 and a wire protector tube 310 which are connected by a tubing link 312. The wire protector tube 310 contains control wires 24'', instrumentation wires 26'', power cables 28', and in some cases hydraulic reservoir makeup line 34'. The tubes 308 and 310 provide a means of pulling drill tool assembly 21 out of bore 18.

Figure 14:
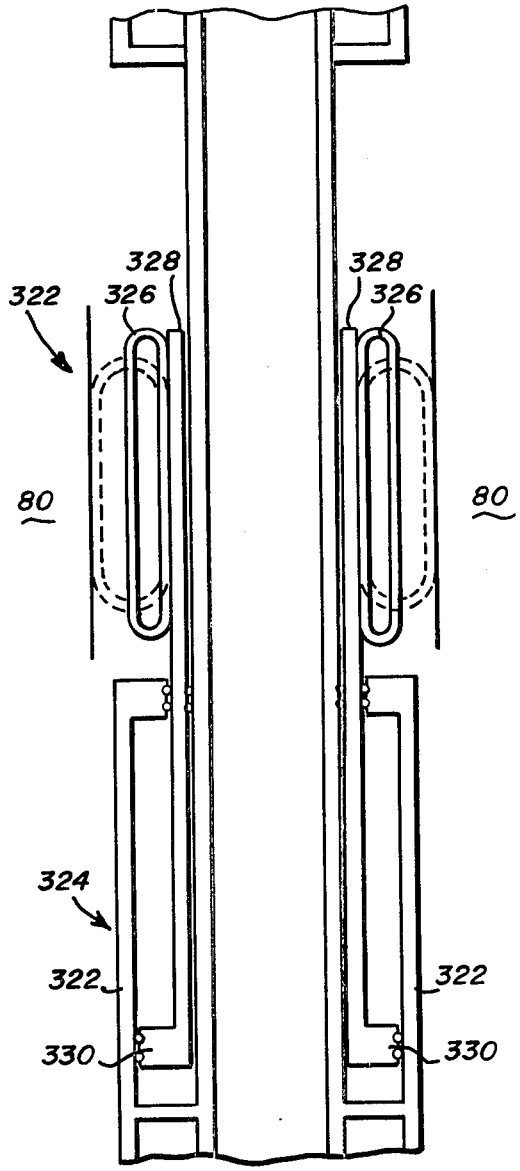
FIG. 14 is a cross-sectional view of an alternative anchor means.

An alternative anchor means may be used to anchor drill tool assembly 21 within bore 18. As illustrated in FIG. 14, an alternative anchor and ram unit 320 includes a flexible anchor assembly 322 and a hydraulic ram assembly 324. Anchor assembly 322 comprises an elastomer bladder 326 of similar construction and function to a lynes inflatable packer which is attached to the hollow cylindrical shaft 328 of ram assembly 324. The bladder 326 is connected to the hydraulic distribution system such that the introduction of hydraulic fluid under pressure forces bladder 326 to expand and engage bore wall 80 (shown in phantom). Release of hydraulic pressure and venting of the bladder 326 through a sufficiently large return line (not shown) allows the bladder 326 to collapse or retract from the bore wall 80 due to the contracting forces of the stretched elastomer bladder 326. The hydraulic ram assembly 324 includes the hollow cylindrical shaft 328 to which is attached piston 330 within cylinder 332. When flexible anchor assembly 322 is engaged, ram assembly 324 operates in a manner similar to ram assemblies 42 or 48 as described above to exert axial force on cutter head 36. Likewise, ram assembly 324 is used to return anchor assembly 322 to its reset position. Alternative anchor and ram unit 320 may be used in conjunction with or in place of anchor and ram units 62 and 63. A path for return drilling fluid is provided within the drill tool assembly 21 since the anchor 322 blocks the annular space.

A combination anchor consisting of dual acting hydraulic actuators similar to those described in anchor assembly 50 above covered by an elastomer bladder offers several advantages over either type individually in that the dual acting actuator can positively force the bladder away from the wall, thus increasing the speed of retraction, and the bladder offers protection to the actuator working surfaces by keeping the piston section enclosed in clean hydraulic fluid and away from any errosive action of the drilling fluid.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A down-hole drilling apparatus comprising, in combination:

a deployment/retrieval reel means;

an umbilical wound about said reel;

a drill tool assembly connected to a first terminal end of said umbilical;

a hydraulic reservoir contained in the drill tool assembly;

a hydraulic distribution system supplied by said reservoir;

an electric motor contained in said drill tool assembly;

a hydraulic pump contained in said drill tool assembly and driven by the electric motor such that the output of the pump supplies high pressure hydraulic fluid to the hydraulic distribution system;

a plurality of hydraulic anchor means contained in said drill tool assembly and supplied by said hydraulic distribution system;

a plurality of hydraulic thruster means contained in said drill tool assembly and supplied by said hydraulic distribution system;

a plurality of hydraulic ram means contained in said drill tool assembly and supplied by said hydraulic distribution system;

a hydraulic system control means contained in said drill tool assembly and connected electrically to said umbilical;

a means for sensing tool location, tool orientation, drill bit rpm, formation temperature and formation pressure contained in the drill tool assembly and said means being electrically connected to said umbilical;

a drill rotation contained in said drill tool assembly;

a cutter head coupled to said drill rotation means and located at the end of said drill tool assembly opposite the umbilical connection;

a means for supplying drilling fluid to the cutter head through the drill tool assembly;

a plurality of position sensing devices for each moving component of the anchor, thruster and ram means;

a processing device electrically connected to a second terminal end of said umbilical for receiving and analyzing data and generating control signals based on the analysis of said data and comparison of said data with preset instructions; and whereby drill tool assembly location and orientation, drill bit rpm and formation temperature and pressure along with positions and pressures associated with said anchor, ram and thruster means are transmitted via the umbilical to the processing device on the surface which generates control signals which are transmitted to the hydraulic system control means within the drill tool assembly via the control awires in the umbilical such that the anchor, ram and thruster means are activated in a manner consistent with preset instructions to cause the drill tool assembly to be moved forward, backward and change the direction of drilling as desired.

2. The down-hole drilling apparatus of claim 1, wherein said umbilical includes a plurality of conduits, electrical wires, and support means within an abrasion resistant covering of generally circular cross-section such that electrical power, instrumentation and control signals, and drilling fluid is supplied to the tool and instrumentation and control signals are sent and received between the surface and the tool.

3. The down-hole drilling apparatus of claim 1, wherein said anchor means includes dual acting hydraulic actuators mounted transversely in the drill tool assembly and connected to feet which are forced into and out of engagement with the bore walls when the anchor means are actuated, said anchor means further including a spring means attached to said hydraulic actuators such that upon failure of hydraulics said spring means moves the feet out of engagement with the bore wall.

4. The down-hole drilling apparatus of claim 1, wherein said hydraulic anchor means comprise an expandable bladder which is constructed of an elastomer material and is expanded into sealing circumferential engagement with the bore wall by internal application of hydrualic pressure such that the bore hole above the bladder is isolated from the bore hole below the bladder, and upon removal of the internal hydraulic pressure the contraction of the elastomer material causes the bladder to move out of engagement with the bore wall.

5. The down-hole drilling apparatus of claim 1, wherein said ram means includes a piston and cylinder mounted adjacent to said anchor means, said cylinder being rigidly fixed to the body of said drill tool assembly, such that a shaft connected to the piston is engaged in a socket rigidly connected to a hydraulic actuator of the anchor means and that upon application of hydraulic pressure to the side of the piston opposite said shaft axial force is transmitted from the cylinder to the cutter head through the drill tool assembly body.

6. The down-hole drilling apparatus of claim 1, wherein said umbilical includes hydraulic supply and return conduits such that hydraulic fluid under pressure can be supplied from the surface to the drill tool assembly.

7. The down-hole drilling apparatus of claim 1, wherein said umbilical includes two coiled tubes connected so that the tubes run parallel to each other, one such tube providing a conduit for the supply of drilling fluid to the drill tool assembly and the second such tube containing control wires, instrumentation wires and power cables.

8. The down-hole drilling apparatus of claim 1 further including a coupling U-joint which is located in the drilling tool assembly such that said ram means and said anchor means are intermediate said coupling U-joint and said cutter head wherein one of said thruster means is located in the drill tool assembly adjacent to said cutter head and another of said thruster means is located adjacent to said coupling U-joint on the cutter head side of said coupling U-joint.

9. The down-hole drilling apparatus of claim 1 wherein said thruster means is slidingly mounted on said drill tool assembly substantially at a midpoint between said cutter head and one pair of said anchor and ram means such that actuation of said thruster means deforms said drill tool assembly changing the angle of attack of said cutter head.

10. The down-hole drilling apparatus of claim 1 further including a plurality of pressure sensing devices mechanically connected to each actuator of the anchor, thruster and ram means and electrically connected to said umbilical.

* * * * *